US005871168A

United States Patent [19]

Rüskens et al.

[11] Patent Number: 5,871,168

[45] Date of Patent: Feb. 16, 1999

[54] WINDING STATION OF A TEXTILE MACHINE FOR PRODUCING CHEESES

[75] Inventors: Herbert Rüskens, Wegberg; Leo Tholen, Heinsberg, both of Germany

[73] Assignee: W. Schlafhorst AG & Company, Germany

[21] Appl. No.: 850,785

[22] Filed: May 2, 1997

[30] Foreign Application Priority Data

May 2, 1996 [DE] Germany ..... 196 17 469.4
May 2, 1996 [DE] Germany ..... 196 17 525.9

[51] Int. Cl.[6] ..... B65H 67/02; B65H 67/08

[52] U.S. Cl. ..... 242/474.2; 242/475.6

[58] Field of Search ..... 242/35.6 E, 35.5 R, 242/35.5 A, 35.6 R, 474.2, 475.6

[56] References Cited

U.S. PATENT DOCUMENTS

| | | | |
|---|---|---|---|
| 4,319,720 | 3/1982 | Ueda | 242/35.6 R X |
| 4,597,540 | 7/1986 | Kiriake | 242/35.5 A |
| 4,917,326 | 4/1990 | Kojima et al. | 242/35.6 E X |
| 5,044,572 | 9/1991 | Grecksch et al. | 242/35.5 A X |
| 5,082,194 | 1/1992 | Grecksch et al. | 242/35.6 R |

FOREIGN PATENT DOCUMENTS

| | | |
|---|---|---|
| 2 336 080 | 8/1974 | Germany . |
| 38 12 643 A1 | 11/1988 | Germany . |
| 40 32 617 A1 | 4/1992 | Germany . |
| 42 41 992 A1 | 6/1994 | Germany . |
| 44 34 304 A1 | 3/1995 | Germany . |
| 44 22 596 A1 | 1/1996 | Germany . |
| 195 39 762.2 | 4/1997 | Germany . |

*Primary Examiner*—Michael Mansen

[57] ABSTRACT

A winding station of a textile machine for producing cheeses is equipped with a device for pickup and transfer of a yarn from a cop to a splicer for joining to a yarn from a cheese, the pickup and transfer device comprising an air-blowing fitting, a pivot tube and a suction fitting connectable via a gripper tube to a suction source. The suction fitting is positioned outside of the normal yarn path and a yarn control device is arranged in front of the suction fitting in the area of the normal yarn path. A yarn end loosened from a spinning cop is pneumatically conveyed to the gripper tube and is threaded into the yarn control device by means of the pivoting of the gripper tube into an intermediate position and the simultaneous pivoting of the pivot tube into an operating position. If a yarn control signal is not present, no yarn splicing attempt is made and a fresh yarn pickup attempt is immediately started, i.e. the pivot tube and the gripper tube directly return into their yarn transfer or yarn pickup position.

30 Claims, 8 Drawing Sheets

WINDING STATION OF A TEXTILE MACHINE FOR PRODUCING CHEESES

FIELD OF THE INVENTION

The present invention relates generally to textile machines for producing yarn cheeses, and more particularly to yarn winding stations for such machines.

BACKGROUND OF THE INVENTION

Textile yarn winding machines which wind yarn into packages, commonly referred to as cheeses, are known to comprise winding stations having a device for picking up the yarn end of a spinning cop to be rewound utilizing a mechanism for pneumatically loosening and transferring the yarn end of the spinning cop to a gripper tube charged with suction air which, in turn, places the yarn end into a splicing device. Winding stations embodied in this manner are known, for example, from German Patent Publications DE 38 12 643 A1 or DE 42 41 992 A1.

German Patent Publication DE 38 12 643 A1 describes a device having a cover, which encloses the spinning cop in the unwinding position, and an unwinding balloon guide disposed above the cover. A pressurized air blowing nozzle moves the yarn end from the cop to a transfer tube, which is parked in a stand-by position. The transfer tube is pivotable to move into a position centered above the unwinding balloon guide and can be charged with suction air to aspirate the yarn end from the cop. The transfer tube subsequently transfers the aspirated yarn end to a splicing device. Among other things, it is disadvantageous in this known device that the transfer tube is positioned directly in the yarn path for picking up the yarn end, which has negative effects particularly in connection with a yarn break detection circuit.

In the device in accordance with DE 42 41 992 A1 a yarn catching funnel is installed above a delivery bobbin disposed in a waiting position and transitions into a tube-shaped connecting element with a lateral aspirating opening. The yarn catcher funnel and the connecting element together have a slit-like opening facing in the cop direction through which the yarn end can pass. A pivotably seated gripper tube can be docked on the lateral aspirating opening of the connecting element to draw the yarn end into the funnel.

This known device makes it possible to prepare the yarn end of a delivery bobbin for respooling in advance so that the respooling process can be immediately started as soon as the spinning cop is moved into a respooling delivery position. However, problems can occur in this device if a yarn break occurs in a spinning cop while being unwound in the delivery position, since it is necessary for repairing the yarn break to employ the gripper tube which has already grasped the yarn end of the cop parked in the waiting position, which can lead to complications.

A further device installed at the winding stations of an automatic cheese winder is described in German Patent Publication DE 44 22 596 A1, wherein the presence of a yarn end pulled off the cop is detected by means of a sensor when the yarn is grasped by a yarn gripper element and initiates a dynamic yarn signal in the sensor to indicate the presence of the yarn end. If the presence of the yarn end is detected, a previously initiated yarn end connection process is continued, while in the absence of an appropriate yarn detection signal the yarn end connection process is interrupted and a cop changing procedure is initiated.

With this known device, the control of the yarn gripping elements required for the yarn end connection process, as well as the control of the service elements employed in connection with a cop changing process, is performed mechanically, i.e. by means of cam disk packages, which are acted upon by a common drive. Such cam disks as a rule perform a 360° rotation during each yarn end connection process and accordingly are mainly designed for a predetermined direction of rotation. Hence, problems can occur with these known devices in stopping the yarn connection process in the absence of the dynamic yarn signal and returning the cam disk packages immediately into their starting "zero" position.

In addition, automatic cheese winders are known from the later published German Patent Publication DE 195 39 762.2, whose winding stations have separate drives for a yarn connection device and for a cop changing device. In this case, the drive for the cop changing device comprises a step motor, which can be controlled by a winding station computer for driving a cam disk package via a gear arrangement for actuating various manipulating devices as well as for stepping a round magazine for receiving spinning cops. By employing a separate step motor for the cop changing device, the cam disk package for the yarn connection device and the cam disk package for the cop changing device can be mechanically separated, so that a largely independent operation of the respective manipulating devices is possible, for example, with separate forward and return movements.

SUMMARY OF THE INVENTION

Based on the above described background, it is a basic object of the present invention to provide an improved device for use in the winding station of textile cheese-producing machines for pneumatic yarn pick-up.

In accordance with the present invention, this object is attained in a winding station in a textile machine for rewinding yarn from cops onto yarn cheeses, wherein the winding station comprises a yarn splicing device for joining a yarn from a cop with a yarn from a cheese, a gripper tube chargeable with suction air and manipulable to place the yarn from the cop into the splicing device, a device disposed in the area of a cop unwinding position of the winding station for picking up a leading end of the yarn from the spinning cop to be rewound and transferring the cop yarn end to the gripper tube, and a yarn control device disposed in a predetermined yarn path to cooperate with the yarn end pickup and transfer device for threading the leading end of the yarn from the spinning cop into the yarn control device. According to the present invention, the yarn end pickup and transfer device comprises a suction fitting positioned outside the predetermined yarn path, with the suction fitting and the gripper tube being selectively dockable with one another and means for pneumatically loosening and transporting the leading end of the yarn from the spinning cop to the suction fitting.

Optionally, a pivot tube may be communicated with the pneumatic loosening means for receiving the loosened cop yarn end, and an associated drive may be provided for pivoting the pivot tube between a yarn transfer position wherein the pivot tube is connected to the suction fitting to transfer the cop yarn end thereto and an operating position wherein the pivot tube is positioned in the area of the predetermined yarn path to cooperate with the gripper tube for placing the cop yarn into the yarn control device. Alternatively, the pivot tube may be omitted in some contemplated embodiments. In each case, the yarn end pickup and transfer device is repeatably actuable for loosening and transferring the cop yarn end.

The present invention has the particular advantage that a yarn control device, which monitors the correct transfer of the yarn picked up at the feed cop, can be positioned underneath the gripper tube directly in the normal yarn winding path without hampering the yarn transfer to the gripper tube. The yarn control device may be fastened in a simple manner in stationary disposition on the winding station housing.

By employment of an independent, separate drive for the elements of the cop changing device, it is additionally provided for positioning the pivot tube repeatedly in sequence in its different operating positions, so that a possibility is provided of repeating the yarn end loosening and transfer process or the process of threading the yarn in the yarn control device without problems and very rapidly when required.

It is also advantageous to provide a winding station computer operatively connected with the drive for the pivot tube and the yarn control device, which assures that the position of the pivot tube can be adapted directly to the actual conditions at the respective winding station, i.e. whether the yarn is caught or the yarn is not caught.

For example, with a pivot tube positioned in its operating position, the absence of an appropriate signal of the yarn control device leads directly to the pivot tube being pivoted back into its yarn transfer position without first starting a yarn connection attempt, thereby avoiding the inevitable failure because of the absence of the cop yarn.

In a preferred embodiment, the drive device for positioning the pivot tube comprises a reversible drive unit, which drives a cam disk package via a reduction gear. The reversible electric motor permits rotation of the cam disk package backward, at least to a limited extent, so that when needed the cam disk package can be returned rapidly into its zero position and thus the direct positioning of the pivot tube into its yarn transfer position is possible without the cam disk package first having to perform one complete revolution.

A step motor is preferably selected as the reversible drive unit, which provides the advantage that, on the one hand, such motors are quite cost-effective and, on the other hand, it is possible by means of such drive units to exactly maintain preset angles of rotation. In addition, when using such motors it is possible to omit additional start or safety clutches or the like.

In connection with an appropriate cam disk gear, a step motor constitutes a relatively cost-effective and dependable construction for the definitive actuation of various manipulation devices required in connection with a cop changing process, which is particularly advantageous if repeated yarn piecing operations may be necessary.

Since the gripper tube is used both during the yarn connection process and the cop changing process, a preferred embodiment of the invention utilizes the cam disk for triggering the gripper tube such that, when required, the gripper tube can be pivoted back from an intermediate position in the area of the start of its pivot movement into its yarn pickup position without problems, so that during the return pivot of the pivot tube there is also no traversing of the cam disk package required.

The yarn pickup and transfer device of the present invention also has the particular advantage that the yarn end, which lies preferably ready in the area of the tip of the delivery cop, can be loosened pneumatically in a simple manner from the tube tip and transferred by means of an air flow present in the area of the yarn end pickup device via a pivot tube directly into a gripper tube, which is ready at the suction fitting. Hence, the gripper tube is advantageously positioned outside of the normal yarn path, so that the yarn cannot be hampered in any way by the gripper tube during the respooling process.

Further advantages of such an embodiment can be seen in that yarn processing or yarn control devices can be positioned fixedly in the area of the path followed by the cop yarn without hindering the yarn transfer, because the relatively short gripper tube inserts the cop yarn, originally grasped in a transfer position, in the form of a tensioned yarn segment in an at least approximately horizontal position into these devices. The gripper tube may advantageously be the same for all types of machines, independently of the type of the unwinding device, for example a round magazine, circulating transport plates, etc. The length of the spinning cop provided also has no effect on the length of the gripper tube.

The yarn end pickup device preferably utilizes an air blowing fitting in an advantageous embodiment of the invention, so that a blown air flow applied by means of a blowing nozzle arrangement acts directly on the end of the cop yarn placed in the area of the tip of the cop tube. However, in a modified embodiment, it is also possible to provide a device in which a yarn end placed in the tube interior is blown or aspirated into the yarn end pickup device by means of a blowing nozzle disposed centered under the cop, such as is known from German Patent Publication DE 38 12 643 A1, for example. In addition it is possible to dispose blowing nozzles in the area of the cop base or thereabove, whereby the feeding of the yarn end to the gripper tube can take place after a yarn break, possibly even after continued cop travel.

It is also preferred that the working height of the blowing fitting, i.e., its elevation relative to a cop whose yarn end is to be pneumatically picked up, can be adjusted to make it possible to accommodate a new cop size, for example in case of a batch change. Thus, the working height of the blowing fitting can be optimally adapted to the cop size used, which has a very positive effect on the degree of effectiveness of the yarn end pickup and transfer operation.

Preferably, the blowing fitting consists of two main components: a base disposed interiorly of the fitting to be displaceable, for example by means of an elongated hole guide, on an appropriate holder of the winding station so as to be adjusted without problems to different working heights. A bushing is displaceably guided on the base to be easily lowered with the base into an operating position in which the bushing at least partially encloses the upper conical yarn windings of the delivery cop.

The base body of the air blowing fitting is configured with an inner contour which counteracts the balloon effect of the yarn during draw-off so as to act as a yarn draw-off accelerator, whereby it is possible with the device of the present invention to achieve high yarn draw-off speeds.

The bushing is preferably formed with a blowing nozzle arrangement chargeable with compressed air to assure a compressed air flow directed on the upper conical yarn windings, which dependably loosens the yarn end from the cop tip and conveys it pneumatically via the pivot tube and the suction fitting to the gripper tube. In the process, the suction prevailing in the gripper tube effectively aids the conveying of the loosened yarn end.

Since the working height of the air blowing fitting is adjustable, while the installed position of the suction fitting, on which the gripper tube docks, has been set to be stationary, it is advantageous to achieve a continuous pneumatic yarn guidance for the length of the pivot tube to be matched to the installed height of the blowing fitting. In a preferred embodiment, the pivot tube is fabricated as a telescoping tube assembly wherein an inner tube is connected for partial movability with the base of the blowing nozzle and an outer tube is connected to a pivot drive matched to the suction fitting in respect to its installed position.

The suction fitting has a continuous slit-like yarn exit opening which makes it possible in a simple manner for the yarn to be moved into the area of the normal yarn path by pivoting of the pivot tube back into its operating position while the gripper tube simultaneously pivots back into its intermediate position, whereby the yarn is automatically threaded into a yarn control and cutting device.

The yarn control and cutting device preferably has a yarn sensor for detecting the presence of the cop yarn and a yarn cutter for trimming the end of the cop yarn. In the described operation, the yarn sensor monitors the successful pneumatic retrieval of the cop yarn and, particularly, if the yarn sensor does not detect the presence of the yarn, the initiation of an corresponding operation for pneumatic retrieval of the yarn end from the cheese is omitted and instead a renewed attempt to pick up the cop yarn is started. The yarn cutter, which becomes active at the start of every cop changing process, prevents the formation of a tail of yarn in case of an unsuccessful splicing process.

Further details of the present invention are described in an exemplary embodiment represented below by means of the drawings.

DETAILED DESCRIPTION OF THE PREFERRED EMBODIMENTS

Figure 1:
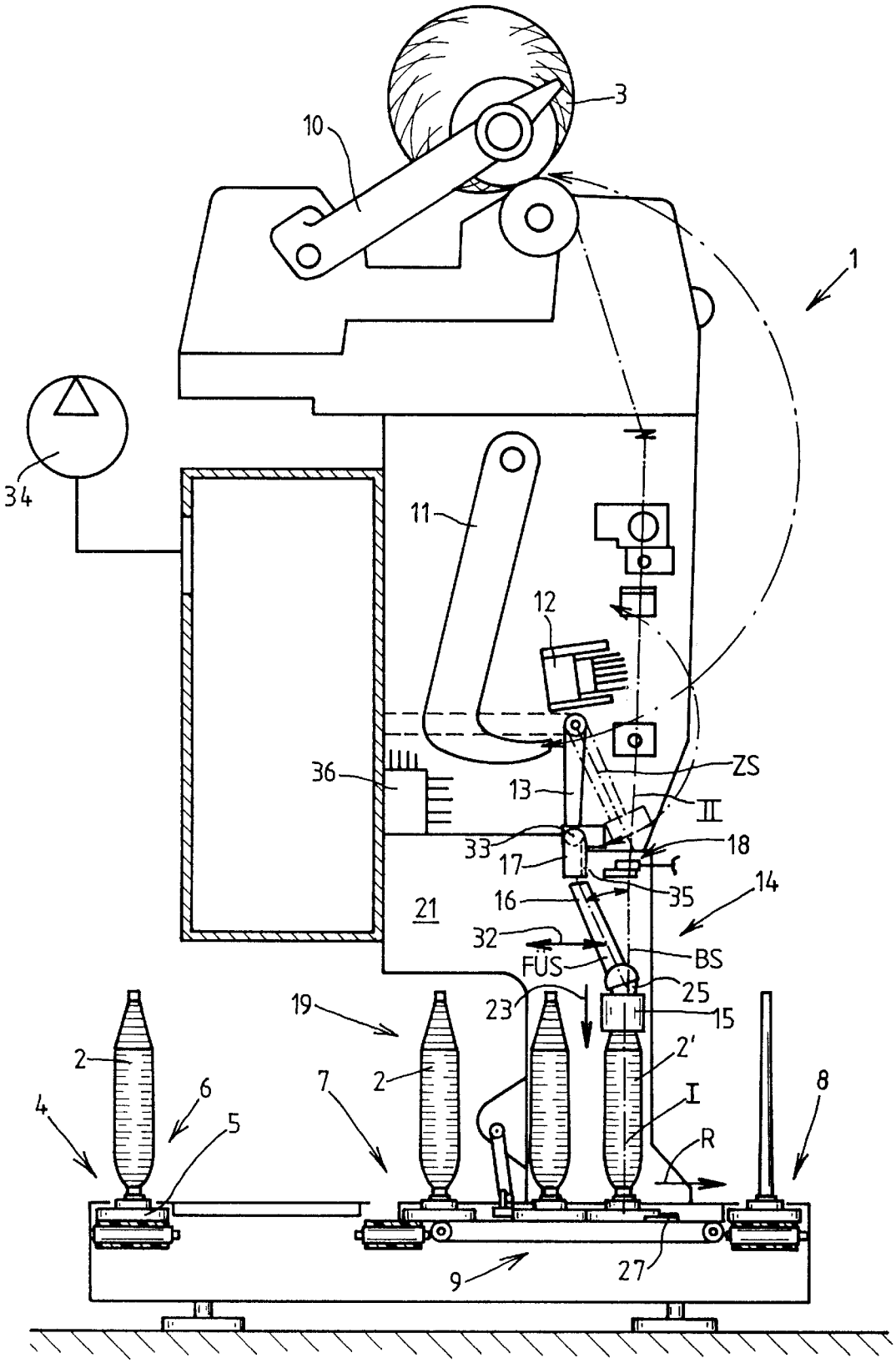
FIG. 1 is an overall side elevational view of a winding station of an automatic cheese winder, according to a preferred embodiment of the present invention.

Referring now to the accompanying drawings, FIG. 1 depicts in side elevation a winding station, identified generally at 1, in a textile machine of the type for winding yarn cheeses. Such textile machines, known as automatic cheese winders, have a plurality of such winding stations 1 disposed in alignment adjacent one other, at which yarn from multiple spinning cops 2 is rewound into cheeses 3 of larger volume. In the process, the spinning cops 2 are transported to the individual winding stations by means of a conveying arrangement 4 disposed at the lower area of the textile machine.

As indicated in FIG. 1, such conveying arrangements 4 are known to have a plurality of different conveyor sections on which the spinning cops 2 are conveyed while standing upright on conveying plates 5, sometimes referred to as pallets or peg trays. Only a cop feed conveyor section 6, a reversing conveyor section 7, an empty tube removal conveyor section 8 and a transverse conveyor section 9 leading to the individual winding stations 1 are represented. In a known manner, multiple spinning cops 2 in sequence approach the unwinding position I of the winding station 1 via the transverse conveying section 9, where the conveying plates 5 are stopped by engagement with a positioning member 27 thereby locating the leading forwardmost spinning cop 2' in proper disposition to deliver its yarn to be rewound.

To initiate such rewinding, each winding station 1 has a number of manipulating elements to accomplish the connection of the yarn end of the spinning cop 2' at the unwinding position with the yarn end of the cheese 3, supported thereabove in a bobbin frame 10. Such manipulating elements include a pivotably seated aspirating nozzle 11 for picking up the trailing yarn from the surface of the cheese 3, a pivotable gripper tube 13, charged with suction air, and a splicing device 12. In the basic process, the aspirating nozzle 11 places the trailing yarn from the cheese 3 into the splicing device 12, while the gripper tube 13 positions the yarn end 57 of the yarn 40 delivered from the spinning cop 2' in the splicing device 12. A special device for picking up the yarn end 57 from the spinning cop 2' and transferring the yarn end to the gripper tube 13 is indicated generally at 14.

FIG. 1 depicts three spinning cops 2 which have been conveyed over the transverse conveying section 9 into the area of a winding station 1, with the leading spinning cop 2' fixed in the unwinding position I by the conveying plate positioning member 27. The yarn end pickup and transfer device 14 is positioned above the spinning cop 2' and essentially consists of an air-blowing fitting 15, a pivotable tube 16 and a suction fitting 17. A yarn control and cutting device 18 is arranged forwardly of a yarn outlet opening 35 of the suction fitting 17 in the area of the normal yarn winding path II followed by the yarn traveling from the cop 2' to the cheese 3.

Figure 2:
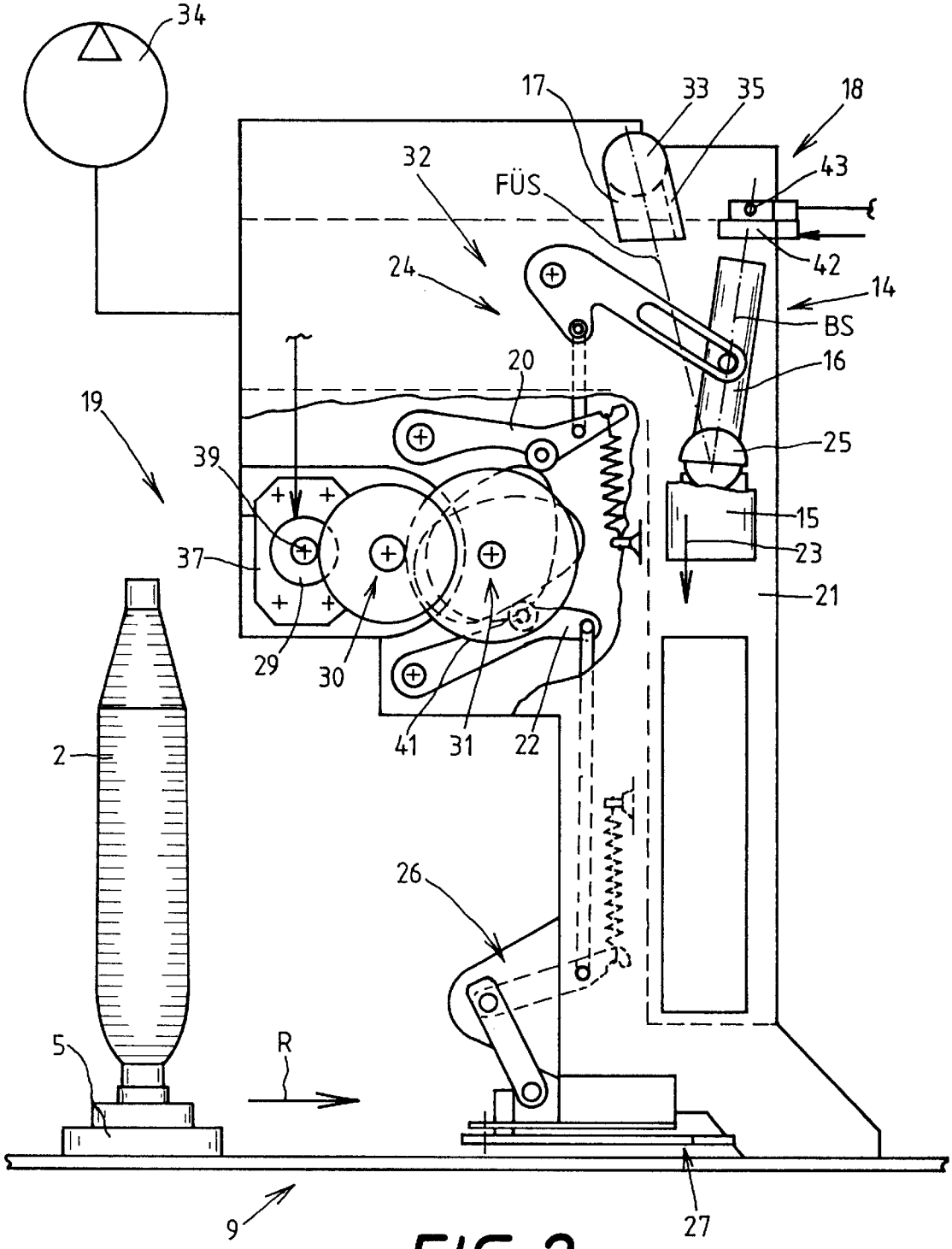
FIG. 2 is a more detailed side elevational view of the lower operational elements of the winding station of FIG. 1, illustrating the drive of the cop changing device.
Figure 3:
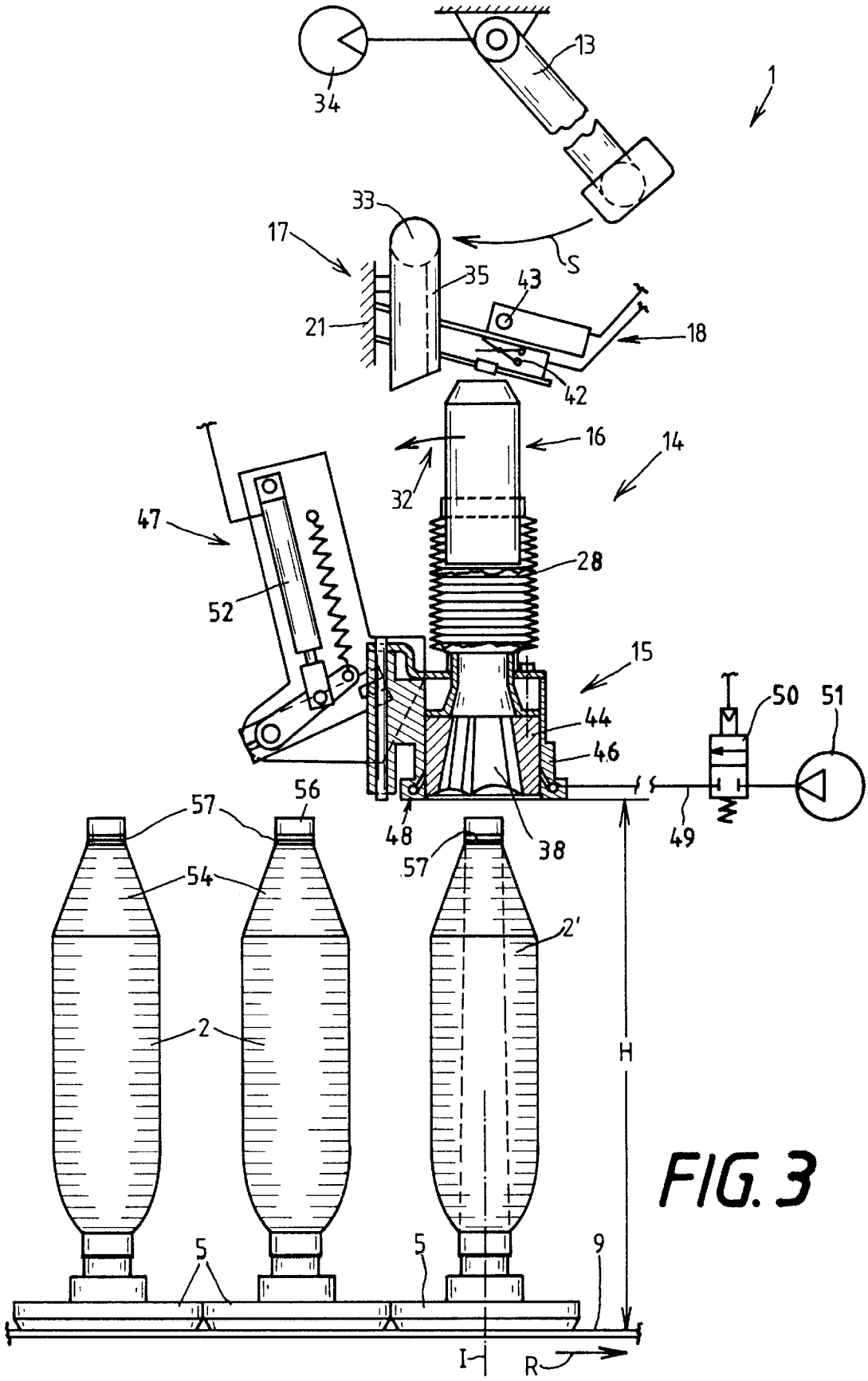
FIG. 3 is another side elevational view showing a yarn end pickup and transfer device in accordance with the present invention in its initial position.

As shown in FIG. 3, the air-blowing fitting 15 essentially comprises a cup-like base 44 movably fixed in place on the winding station housing 21 by means of a holder to be adjustable in its working elevation relative to a cop 2' at the unwinding position I. An annular bushing 46 is displaceably fastened on the base 44 to extend outwardly about the base 44 and to be movable axially downwardly in the direction of the arrow 23 by means of an appropriate actuating device 47. For example, a pneumatic cylinder (FIG. 3–5) or a cam disk-controlled adjusting lever preferably driven by a step motor (FIG. 2) can be provided as the actuating device for vertical displacement of the bushing of the air-blowing fitting. The base 44 of the air-blowing fitting is fabricated to define an interior contour to function as a yarn draw-off accelerator and is connected with the pivot tube 16 via a hinged connector, for example a ball joint connector. The air-blowing fitting 15 additionally has a blowing nozzle arrangement, described hereinafter, which is connected via an appropriate pneumatic line with a compressed air source.

The pivot tube 16, which may be advantageously embodied as a telescoping tube (as described for example in FIG. 6 hereinafter), can be shifted via a cam disk-controlled pivot device 32 (shown in FIG. 2 but only schematically in FIG. 1) out of an initial or operating position (BS) shown in FIG. 2 into the yarn end transfer position (FÜS) indicated in FIG. 1. In the yarn end transfer position, the pivot tube 16 connects the air-blowing fitting 15 with the suction fitting 17. The suction fitting 17 is open at the bottom and has a lateral connection opening 33, to which can be docked the pivotably seated gripper tube 13, which is connected to a suction source 34. The suction fitting 17 also has a lengthwise slit-like yarn outlet opening 35 facing in the cop conveying direction R.

As represented in FIG. 2, the drive of the manipulating devices of the cop changing device, identified as a whole by the reference number 19, comprises a step motor 29 actuated by a winding station computer 36. The step motor 29 acts on a set of cam disks 31 via a gear arrangement, generally indicated at 30. Control levers 20, 22 rest against the cam disk set 31 and are connected with further lever rods 24, 26 to actuate movement of the conveying plate positioning member 27 and the pivot tube 16, thereby manipulating the cop changing device 19.

The step motor 29 is fixed in place on the winding station housing 21 by a bearing plate 37 or the like. A pinion gear 39 of the step motor 29 meshes with an initial gear wheel of the gear arrangement 30. A final gear wheel of this gear arrangement 30 engages with a gear wheel 41 connected to the cam disk set 31. Thus, as can be seen, a definitive step-down of the rpm of the step motor, normally from 240 to 500 rpm, takes place because of this gear arrangement 30. Because of the lowered rpm and the comparatively small torque to be transferred, the gear can remain unencapsulated. The gear wheels are preferably made of plastic.

Figure 6:
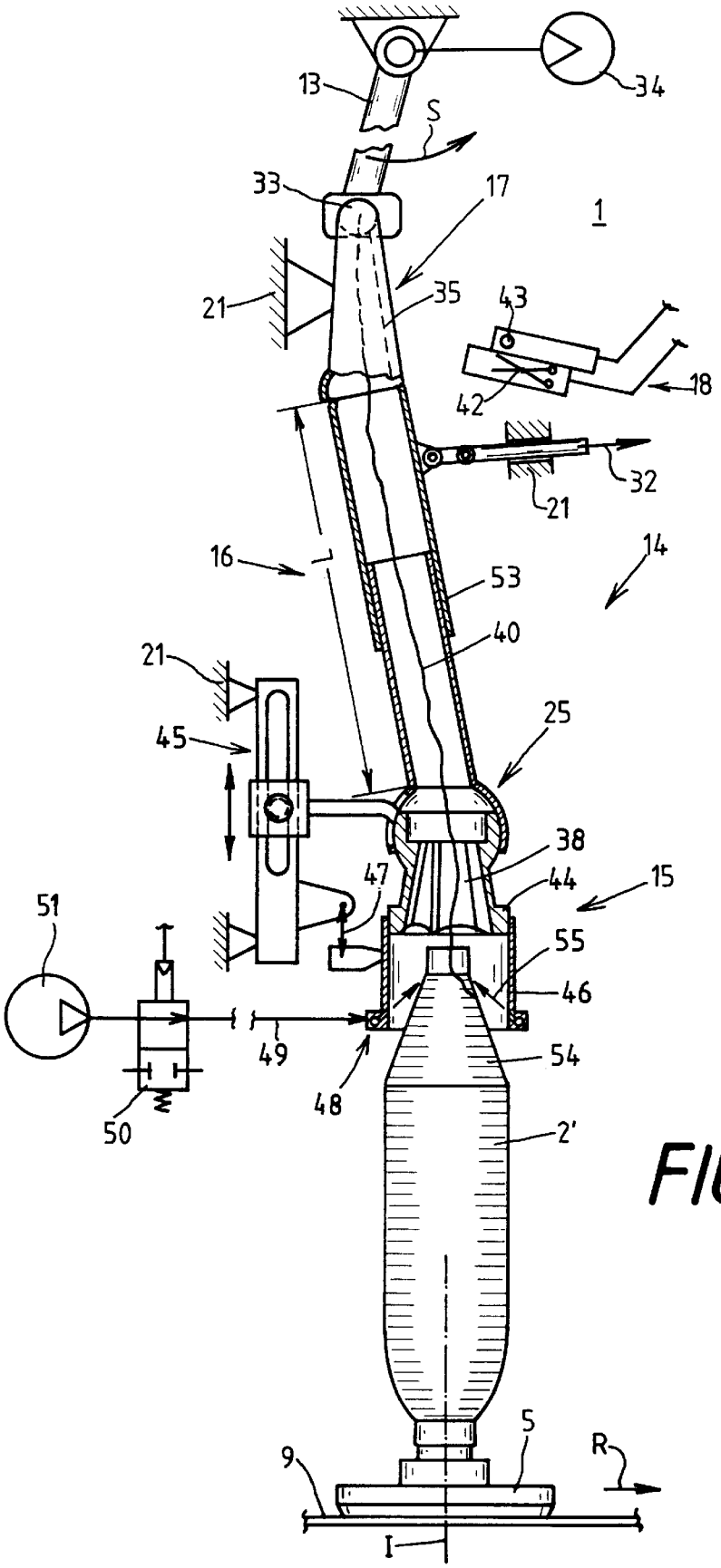
FIG. 6 is another side elevational view showing a yarn end pickup and transfer device having an alternative embodiment of pivot tube in accordance with the present invention.

FIG. 3 similarly illustrates three spinning cops 2 which have been conveyed over a transverse conveying section 9 into the area of a winding station 1, wherein the leading spinning cop 2' is fixed in a winding position I by positioning member 27. One preferred embodiment of a yarn end pickup and transfer device 14 essentially comprising an air-blowing fitting 15, a pivot tube 16 and a suction fitting 17, as already mentioned above, is positioned above the spinning cop 2'. Another preferred embodiment of a yarn end pickup and transfer device 14 is shown in FIG. 6. In each case, a yarn control and cutting device 18 is arranged in front of a yarn outlet opening 35 of the suction fitting 17.

As can be particularly seen by means of the exemplary embodiment represented in FIG. 6, the base 44 of the air-blowing fitting 15 is adjustable in its working height H by means of a slotted holder 45 which can be fixed in place on the winding station housing 21. The holder 45 is not shown in FIG. 3 for sake of clarity. The annular bushing 46 is displaceably fastened on and extends over the base 44, the bushing 46 being downwardly movable by means of an actuating device 47. FIG. 3 shows another embodiment of such an actuating device 47.

Figure 4:
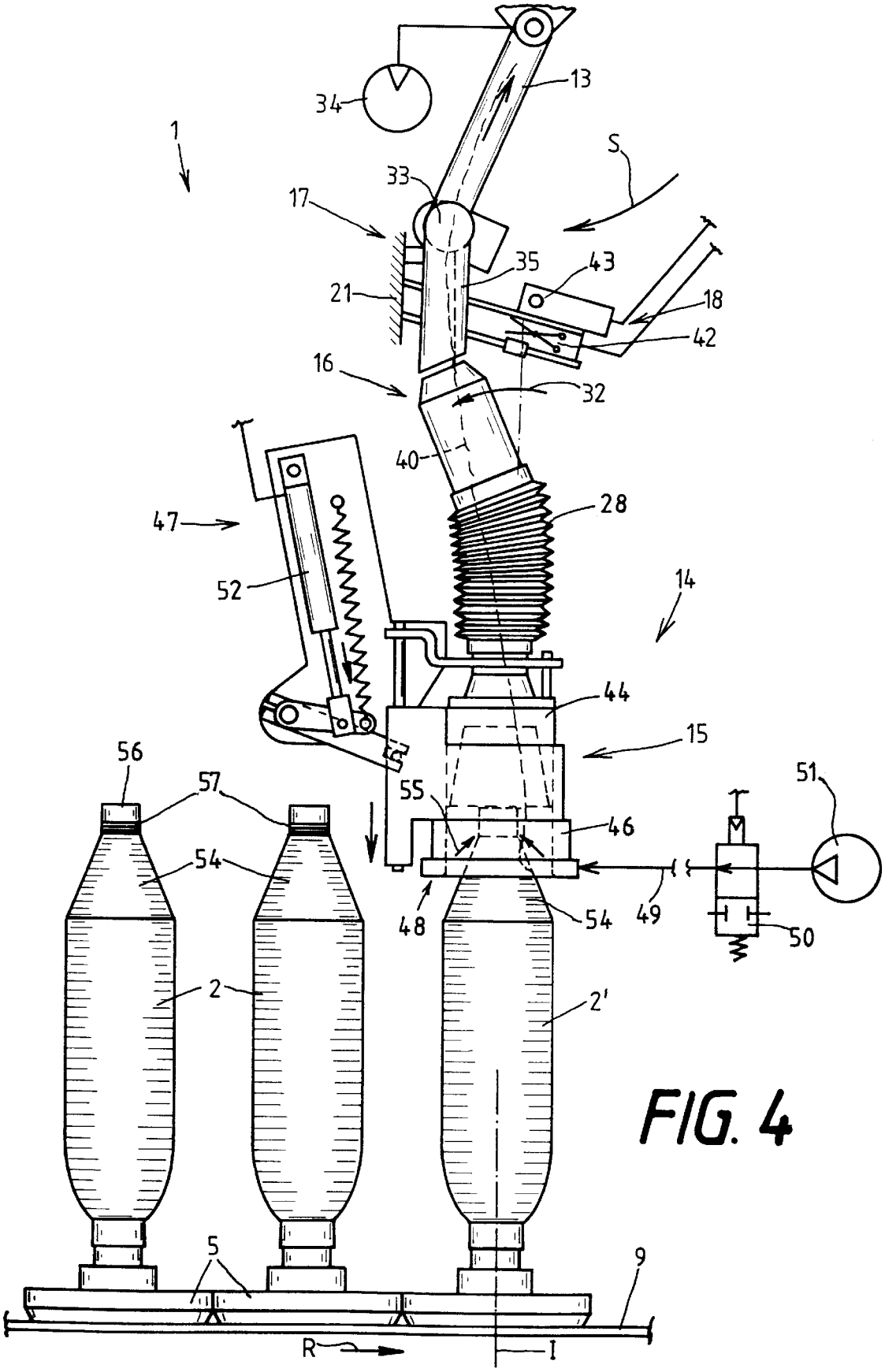
FIG. 4 is a side elevational view similar to FIG. 3 showing the yarn end pickup and transfer device thereof in the course of transferring the yarn end to a gripper tube docked to the suction fitting.
Figure 5:
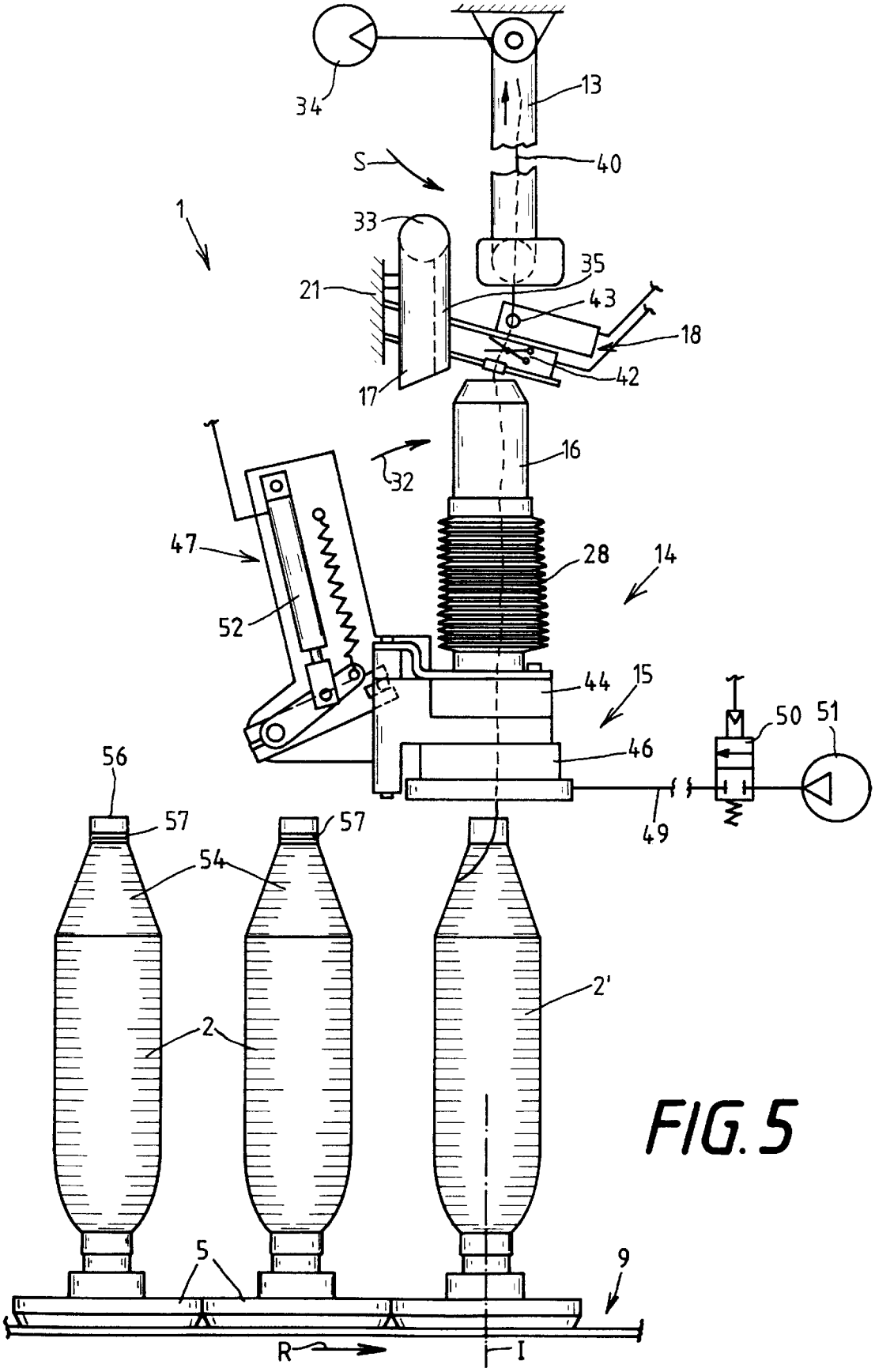
FIG. 5 is a side elevational view similar to FIG. 3 showing the yarn end pickup and transfer device in the course of threading the yarn end into a yarn control and cutting device.

As previously indicated, the base 44 is configured with its interior contour defining a yarn draw-off accelerator 38 and is connected with the pivot tube 16 via a hinged connector, for example a ball joint connector 25, such as depicted in FIGS. 1, 2 and 6, or a flexible hose 28, such as shown in FIGS. 3–5.

The annular bushing 46 is formed with an arrangement of blowing nozzles, indicated at 48, which is connected with a compressed air source 51 via an appropriate pneumatic line 49, in which a directional control valve 50 or the like is disposed. The actuating device 47 for the bushing 46 may be embodied as a pneumatic cylinder 52 or as a cam-operated adjusting lever, for example.

The pivot tube 16, which can be embodied as a telescoping tube 53, as represented in the exemplary embodiment of FIG. 6, can be selectively shifted via a suitable pivot device 32, e.g., preferably cam disk-controlled, between an initial operating position, represented in FIG. 3 and 5, and a yarn end transfer position, represented in FIGS. 4 and 6. In the yarn end transfer position in accordance with FIGS. 4 and 6 the pivot tube 16 connects the blowing fitting 15 with the suction fitting 17.

The operation of the device may thus be understood. Spinning cops 2 are continuously conveyed by means of the conveying device 4 into the area of the winding position I, whereat the leading spinning cop, identified at 2', is fixed in the proper winding position I by the positioning member 27. As represented, the yarn end pickup and transfer device 14 disposed in the area of the winding position I above the spinning cop 2' takes up its initial position at this time. As already mentioned above, by means of the holder 45 (FIG. 6) the working height H of the air-blowing fitting 15 can be adjustably set exactly to the length of the spinning cops 2' which are to be processed.

Subsequently, as represented generally in FIG. 1 and in greater detail in FIG. 4, the bushing 46 of the air-blowing fitting 15 is lowered over the upper conical windings 54 of the spinning cop 2' by means of the associated actuating device, e.g., device 47, and the step motor 29 acting through the downstream connected cam-disk gearing pivots the pivot tube 16 into its yarn end transfer position FÜS to be coupled with the suction fitting 17. The blowing nozzle arrangement 48 is charged with pressurized air via the directional control valve 50. The blowing air flow 55 resultantly generated within the air-blowing fitting 15 pneumatically removes the leading yarn end 57 on the cop 2', placed for example on the tube tip 56 in a previous preparatory operation, and conveys the yarn end into and through the pivot tube 16 to the suction fitting 17.

At this time, the gripper tube 13 is disposed in the yarn end pickup position and docked at the lateral connecting opening 33 of the suction fitting 17 and is connected with the suction source 34 whereby the loosened yarn end 57 together with a trailing length of yarn 40 from the cop 2' is aspirated via the air-blowing fitting 15, the pivot tube 16 and the suction fitting 17 into the gripper tube 13.

Subsequently, as represented in FIG. 5, the pivot tube 16 is pivoted back into the initial "operating" position BS and, at the same time, the gripper tube 13 undocks from the suction fitting 17 and moves into an intermediate position ZS(indicated generally in broken lines in FIG. 1 and in greater detail in FIG. 5), e.g., by means of a cam disk gear (not shown) driven by the step motor, preferably reversible, or a separate drive. With the aid of the pivot tube 16 which pivots at the same time into the operating position BS, the yarn 40 is withdrawn from the suction fitting 17 through the slit-like yarn outlet opening 35 therein and placed into the yarn control and cutting device 18 positioned in front of the opening 35. More particularly, the yarn control and cutting device 18 consists of a yarn sensor 43 and a yarn cutter 42.

If the yarn sensor 43 determines that there is no yarn 40 present, the actuation of the aspiration nozzle 11 to carry out the process of aspirating the trailing yarn end from the cheese 3 is suppressed and, first, at least one fresh attempt is made to pick up the yarn 40 from the cop 2' by means of the yarn end pickup and transfer device 14 so that the yarn 40 can be inserted into the splicing device 12. Thus, the air-blowing fitting 15 is again lowered over the upper conical windings 54 of the spinning cop 2', the pivot tube 16 is again pivoted into the yarn end transfer position FÜS, and another attempt is made by the blowing nozzle arrangement 48 in the air-blowing fitting 15 to loosen the leading yarn end 57 from the spinning cop 2'. If successful, then as above described the following length of yarn 40 is transferred via the pivot tube 16 to the suction fitting 17 and thus to the gripper tube 13 which pivots into the intermediate position ZS to thread the yarn 40 into the yarn control and cutting device 18 with the aid of the simultaneous pivoting of the pivot tube 16 into the operating position BS.

If this renewed attempt (and any predeterminable number of further attempts) should also fail, a cop changing process is performed to move the spinning cop 2' out of the winding position I and replace it by the next spinning cop 2 in the waiting position on the conveyor 9, which thereby becomes the active spinning cop 2' to be unwound.

The yarn cutter 42 is automatically actuated during each cop changing process. Although 80% to 90% of such cuts are meaningless, this operation assures that no yarn from a cop can become caught at the winding position during a cop change and later be pulled through the textile machine as a stray yarn tail, which could lead to complications.

As a possible alternative embodiment, it is contemplated that a yarn end pick-up and transfer device may be constructed and operated in accordance with the present invention without utilizing a pivot tube 16 extending between the air blowing fitting 15 and the suction fitting 17. Such a possible embodiment is illustrated in FIGS. 7 and 8, wherein reference numerals corresponding to those used in FIGS. 1–6 identify corresponding elements of this alternative embodiment.

Figure 7:
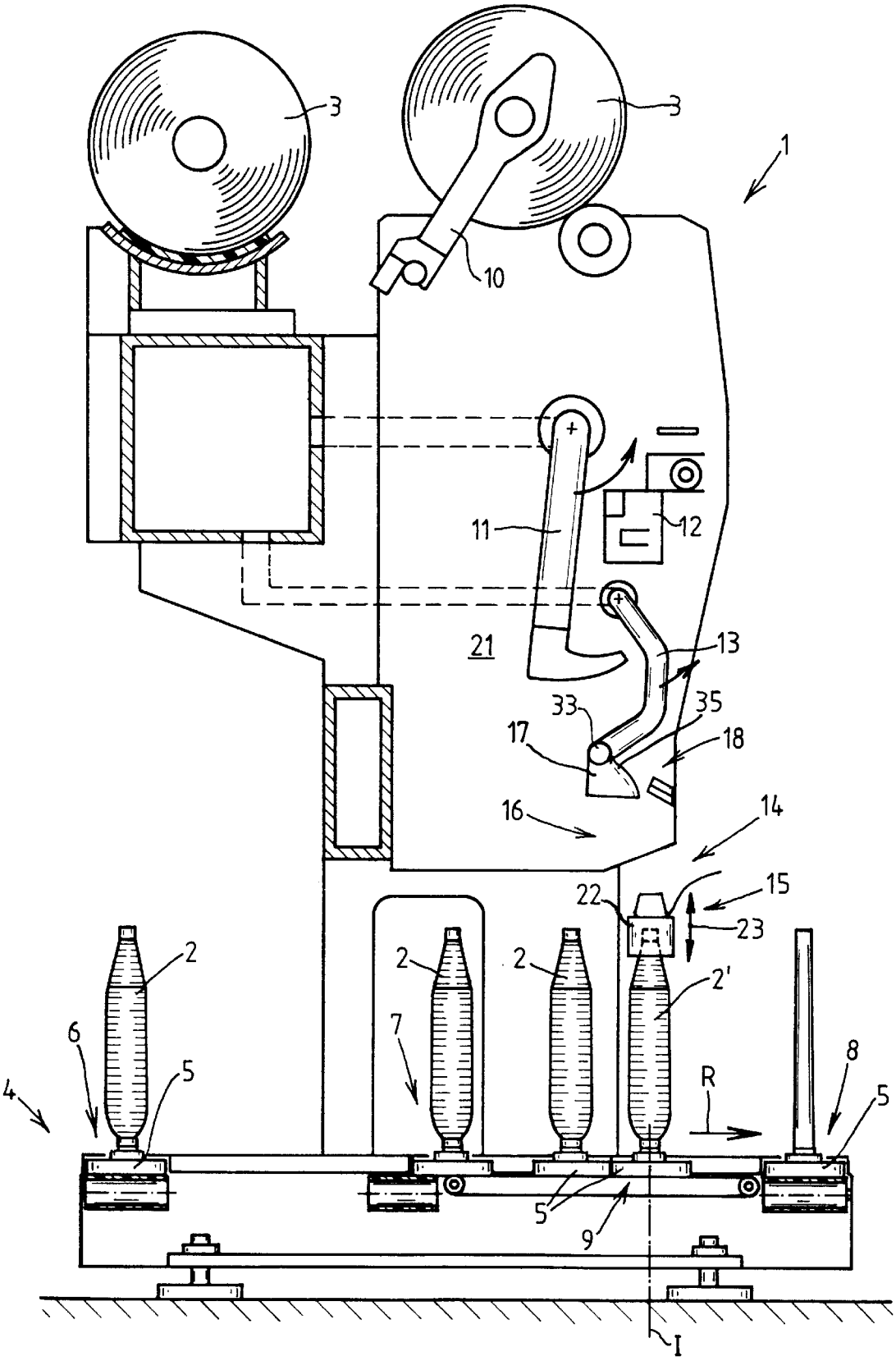
FIG. 7 is another overall side elevational view of a winding station of an automatic cheese winder, similar to FIG. 1, showing an alternative embodiment of the present invention.

Similar to FIG. 1, FIG. 7 shows a winding station of an automatic cheese winder in side elevation with a spinning cop 2' at the unwinding position I wherein the air blowing fitting 15 is disposed over the upper tip end of the cop 2'. As in the embodiment of FIGS. 1–6, the air blowing fitting 15 is movably situated on the winding station housing 21 and has a displaceable annular bushing 46 (FIG. 8). Interiorly, the air-blowing fitting 15 contoured to form a yarn draw-off accelerator into which a blowing nozzle arrangement directs compressed air received via a pneumatic line 49 through a control valve 50 communicated with a compressed air source 51. In this manner, the air-blowing fitting 15 loosens the leading yarn end from the cop 2' and directs the yarn end upwardly toward the suction fitting 17.

Figure 8:
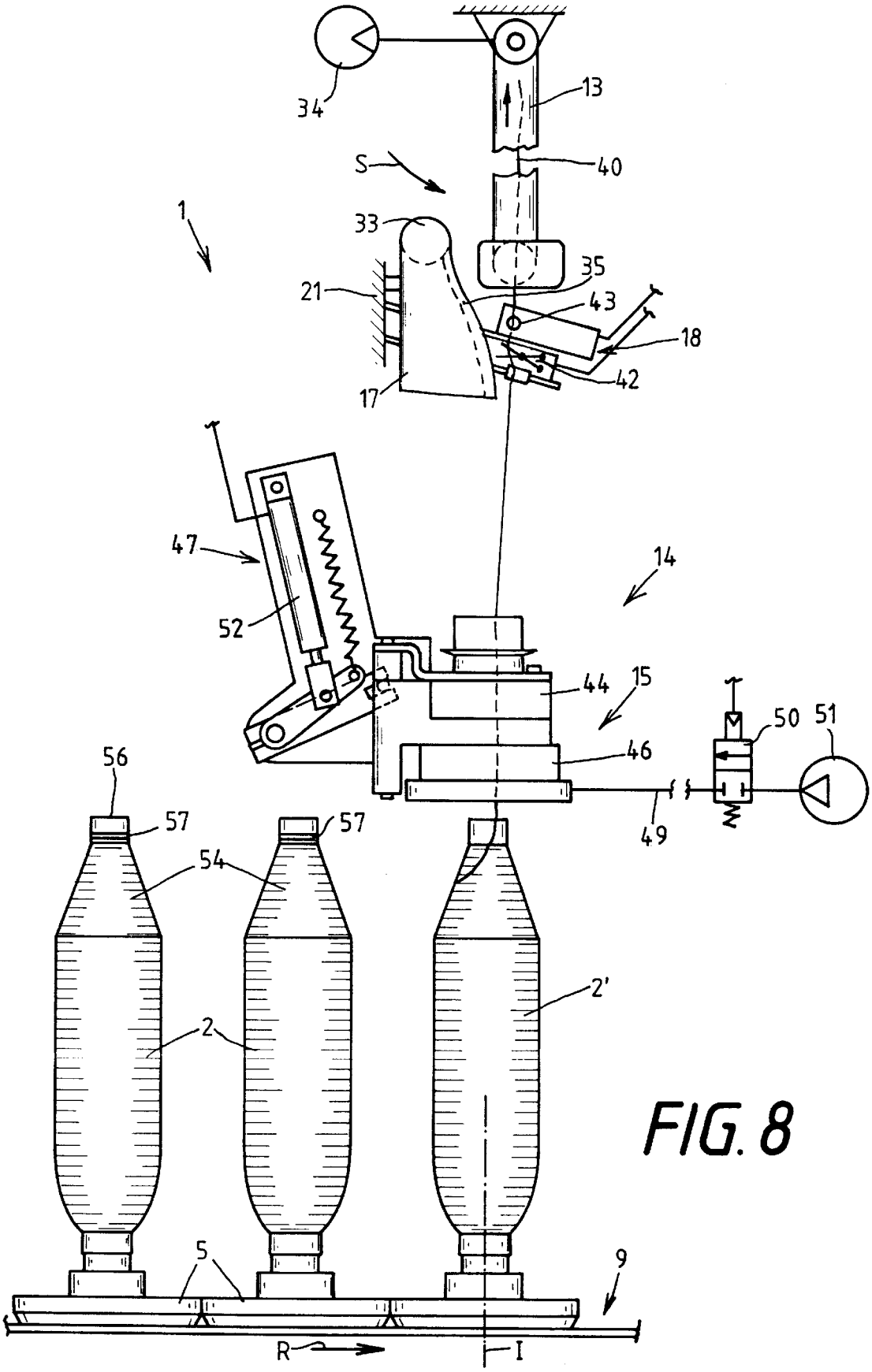
FIG. 8 is a more detailed side elevational view of the lower operational elements of the winding station of FIG. 7.

In this embodiment of FIGS. 7 and 8, the suction fitting 17 is of a modified configuration from that of FIGS. 1–6. As shown, the suction fitting defines a relatively enlarged interior yarn-receiving area of an increasing outward taper facing downwardly toward the air-blowing fitting 15. As in the embodiment of FIGS. 1–6, the suction fitting 17 has a lateral connection opening 33 for docking with a pivotable gripper tube 13 connected to a suction source 34, whereby suction can be applied through the downward opening of the suction fitting 17 to assist entrance of the cop yarn end into the fitting 17 and therefrom into the gripper tube 13. In this manner, the cop yarn end dislodged by the blowing fitting 15 travels upwardly and into the cup-shaped interior of the suction fitting 17.

Otherwise, the basic structure and operation of the embodiment of FIGS. 7 and 8 is substantially as above-described. The suction fitting 17 is provided with a forwardly facing slit 35 through which the cop yarn is withdrawn from the suction fitting 17 upon pivoting movement of the gripper tube 13 following transfer of the cop yarn. A yarn control and cutting device 18 is disposed forwardly adjacent the suction fitting 17 and functions in the same manner as described with respect to FIGS. 1–6.

As a whole the device in accordance with the invention represents an uncomplicated and dependable device, which assures the rapid and dependable pickup of the yarn end from a spinning cop 2', as well as a dependable transfer of the yarn end to a pivotably seated gripper tube 13.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A winding station in a textile machine for rewinding yarn from spinning cops onto yarn cheeses, the winding station comprising:

(a) a yarn splicing device for joining a yarn from a spinning cop with a yarn from a cheese, (b) a gripper tube chargeable with suction air and manipulable to place the yarn from the spinning cop into the splicing device, (c) a yarn end pick-up and transfer device disposed directly in the area of a spinning cop unwinding position of the winding station for picking up a leading end of the yarn from the spinning cop to be rewound and transferring the cop yarn end to the gripper tube, (d) a yarn control and cutting device disposed in front of the yarn splicing device in a predetermined yarn path to cooperate with the yarn end pickup and transfer device, the yarn end pick-up and transfer device being adapted for threading the leading end of the yarn from the spinning cop into the yarn control and cutting device, and (e) the yarn end pickup and transfer device comprising a suction fitting positioned outside the predetermined yarn path wherein the yarn control and cutting device is disposed forwardly of the suction fitting, the suction fitting and the gripper tube being selectively dockable with one another, and means for pneumatically loosening and transporting the leading end of the yarn from the spinning cop to the suction fitting, the yarn end pickup and transfer device being repeatably actuable for loosening and transferring the cop yarn end.

2. The winding station in accordance with claim 1, wherein the yarn end pickup and transfer device further comprises a pivot tube communicated with the pneumatic loosening means for receiving the loosened cop yarn end, and a drive for pivoting the pivot tube between a yarn transfer position wherein the pivot tube is connected to the suction fitting to transfer the cop yarn end thereto and an operating position wherein the pivot tube is positioned in the area of the predetermined yarn path to cooperate with the gripper tube for placing the cop yarn into the yarn control and cutting device.

3. The winding station in accordance with claim 2, and further comprising a winding station computer for actuating the drive for actuating movement of the pivot tube.

4. The winding station in accordance with claim 3, wherein the winding station computer controls movement of the pivot tube between the operating position and the yarn transfer position and wherein the yarn control and cutting device includes a sensor for detecting the presence or absence of the yarn and activating the winding station computer for controlling the movement of the pivot tube.

5. The winding station in accordance with claim 2, wherein the drive for the pivot tube includes a reversible drive unit and a cam disk gear arrangement.

6. The winding station in accordance with claim 5, wherein the reversible drive unit comprises a step motor.

7. The winding station in accordance with claim 5, further including a cop changing device for positioning the spinning cop under the yarn end pick-up and transfer device and wherein the drive for the pivot tube is arranged for actuating the cop changing device.

8. The winding station in accordance with claim 1, wherein the gripper tube is positionable in a yarn end pick-up position and an intermediate position for threading the yarn end from the spinning cop into the yarn control and cutting device, the gripper tube being adapted for returning to the yarn end pickup position in response to absence of a predetermined control signal.

9. A winding station in a textile machine for rewinding yarn from spinning cops onto yarn cheeses, the winding station comprising:

(a) a yarn splicing device for joining a yarn from spinning cop with a yarn from a cheese, (b) a gripper tube chargeable with suction air and manipulable to place the yarn from the spinning cop into the splicing device, and (c) a yarn end pick-up and transfer device operative for picking up a leading end of the yarn from the spinning cop to be rewound and transferring the cop yarn end to the gripper tube, the yarn end pickup and transfer device comprising a suction fitting having a lateral connecting opening for docking with the gripper tube, and means disposed in the area of a cop unwinding position of the winding station for pneumatically loosening and transporting the leading end of the yarn from the spinning cop to the suction fitting.

10. The winding station of claim 9, wherein the yarn end pickup and transfer device further comprises a pivot tube communicated with the pneumatic loosening means for receiving the loosened cop yarn end and connectable to the suction fitting to transfer the cop yarn and thereto.

11. The winding station in accordance with claim 10, wherein the pivot tube has a variable length.

12. The winding station in accordance with claim 10, wherein the pivot tube comprises a first tube element connected with a pivot drive and a second tube element telescopical with respect to the first tube and connected with the air-blowing fitting.

13. The winding station in accordance with claim 9, wherein the yarn loosening means comprises an air-blowing fitting.

14. The winding station in accordance with claim 13, wherein the air-blowing fitting has a working height relative to the size of the spinning cop, the air-blowing fitting being adjustable to set the working height to the spinning cop being used.

15. The winding station in accordance with claim 13, wherein the air-blowing fitting comprises a base, means for supporting the base for elevational adjustment, and a busing disposed displaceably with respect to the base.

16. The winding station in accordance with claim 15, wherein the air-blowing fitting comprises an actuating device for displacing the bushing into a disposition relative to a spinning cop positioned in the unwinding position to at least partially enclose an upper end of the cop having conical yarn windings.

17. The winding station in accordance with claim 15, wherein the base of the air-blowing fitting comprises a yarn draw-off accelerator.

18. The winding station in accordance with claim 15, wherein the bushing defines a blowing nozzle arrangement chargeable with compressed air.

19. The winding station in accordance with claim 9, wherein the suction fitting comprises a continuous opening slit for withdrawal of a yarn from the cop held in the gripper tube.

20. The winding station in accordance with claim 19, and further comprising a yarn control and cutting device positioned adjacent the yarn opening slit.

21. The winding station in accordance with claim 20, wherein the yarn control and cutting device comprises a sensor for detecting the presence of a yarn and a yarn cutter.

22. A winding station in a textile machine for rewinding yarn from spinning cops onto yarn cheeses, the winding station comprising:

(a) a yarn splicing device for joining a yarn from a spinning cop with a yarn from a cheese;

(b) a gripper tube chargeable with suction air and manipulable to place the yarn from the spinning cop into the splicing device;

(c) a yarn end pick-up and transfer device disposed directly in the area of a spinning cop unwinding position of the winding station for picking up a leading end of the yarn from the spinning cop to be rewound and transferring the cop yarn end to the gripper tube;

(d) a yarn control and cutting device disposed in front of the yarn splicing device in a predetermined yarn path to cooperate with the yarn end pickup and transfer device, the yarn end pick-up and transfer device being adapted for threading the leading end of the yarn from the spinning cop into the yarn control and cutting device;

(e) the yarn end pickup and transfer device comprising:

(i) a suction fitting positioned outside the predetermined yarn path wherein the yarn control and cutting device is disposed forwardly of the suction fitting, the suction fitting and the gripper tube being selectively dockable with one another, (ii) means for pneumatically loosening and transporting the leading end of the yarn from the spinning cop to the suction fitting, (iii) a pivot tube communicated with the pneumatic loosening means for receiving the loosened cop yarn end, and (iv) a drive for pivoting the pivot tube between a yarn transfer position wherein the pivot tube is connected to the suction fitting to transfer the cop yarn end thereto and an operating position wherein the pivot tube is positioned in the area of the predetermined yarn path to cooperate with the gripper tube for placing the cop yarn into the yarn control and cutting device; and (f) wherein the yarn end pickup and transfer device is repeatably actuable for loosening and transferring the cop yarn end.

23. The winding station in accordance with claim 22, further comprising a winding station computer for actuating the drive for actuating movement of the pivot tube.

24. The winding station in accordance with claim 23, wherein the winding station computer controls movement of the pivot tube between the operating position and the yarn transfer position and wherein the yarn control and cutting device includes a sensor for detecting the presence or absence of the yarn and activating the winding station computer for controlling the movement of the pivot tube.

25. The winding station in accordance with claim 22, wherein the drive for the pivot tube includes a reversible drive unit and a cam disk gear arrangement.

26. The winding station in accordance with claim 25, wherein the reversible drive unit comprises a step motor.

27. The winding station in accordance with claim 25, further including a cop changing device for positioning the spinning cop under the yarn end pick-up and transfer device and wherein the drive for the pivot tube is arranged for actuating the cop changing device.

28. A winding station in a textile machine for rewinding yarn from spinning cops onto yarn cheeses, the winding station comprising:

(a) a yarn splicing device for joining a yarn from a spinning cop with a yarn from a cheese, (b) a gripper tube chargeable with suction air and manipulable to place the yarn from the spinning cop into the splicing device, and (c) a yarn end pick-up and transfer device operative for picking up a leading end of the yarn from the spinning cop to be rewound and transferring the cop yarn end to the gripper tube, the yarn end pickup and transfer device comprising a suction fitting having a lateral connecting opening for docking with the gripper tube, means disposed in the area of a cop unwinding position of the winding station for pneumatically loosening and transporting the leading end of the yarn from the spinning cop to the suction fitting, and a pivot tube communicated with the pneumatic loosening means for receiving the loosened cop yarn end and connectable to the suction fitting to transfer the cop yarn end thereto.

29. The winding station in accordance with claim 28, wherein the pivot tube has a variable length.

30. The winding station in accordance with claim 28, wherein the pivot tube comprises a first tube element connected with a pivot drive and a second tube element telescopical with respect to the first tube and connected with the air-blowing fitting.

* * * * *